US007726763B2

(12) United States Patent
Ochiai et al.

(10) Patent No.: US 7,726,763 B2
(45) Date of Patent: Jun. 1, 2010

(54) INK JET PRINTING APPARATUS AND INK JET PRINTING METHOD

(75) Inventors: Takashi Ochiai, Machida (JP); Hitoshi Tsuboi, Kawasaki (JP); Satoshi Wada, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/949,998

(22) Filed: Dec. 4, 2007

(65) Prior Publication Data

US 2008/0136855 A1 Jun. 12, 2008

(30) Foreign Application Priority Data

Dec. 11, 2006 (JP) ..... 2006-333591

(51) Int. Cl.
*B41J 2/205* (2006.01)

(52) U.S. Cl. ..... 347/15; 347/43

(58) Field of Classification Search ..... 347/41, 347/15, 43, 12; 358/1.2, 1.9
See application file for complete search history.

(56) References Cited

U.S. PATENT DOCUMENTS

| | | | | |
|---|---|---|---|---|
| 7,290,854 | B2 * | 11/2007 | Mizutani et al. | 347/41 |
| 2004/0119766 | A1 | 6/2004 | Shibata et al. | 347/12 |
| 2005/0219279 | A1 | 10/2005 | Goto et al. | 347/5 |
| 2006/0119632 | A1 | 6/2006 | Ochiai et al. | 347/15 |
| 2006/0119660 | A1 | 6/2006 | Ochiai et al. | 347/40 |
| 2006/0274099 | A1 | 12/2006 | Jahana et al. | 347/15 |
| 2008/0049057 | A1 | 2/2008 | Ochiai et al. | 347/12 |

* cited by examiner

*Primary Examiner*—Lamson D Nguyen
(74) *Attorney, Agent, or Firm*—Fitzpatrick, Cella, Harper & Scinto

(57) ABSTRACT

An ink jet printing apparatus and an ink jet printing method can enable high quality printing, without causing uneven thickness in a conveying direction, using a printing head having a plurality of ejection port arrays. To this end, the printing is performed by making distribution ratios of printing in each ejection port array in the printing head different from one another according to gradation.

5 Claims, 18 Drawing Sheets

INK JET PRINTING APPARATUS AND INK JET PRINTING METHOD

BACKGROUND OF THE INVENTION

1. Field of the Invention

The present invention relates to an ink jet printing apparatus and an ink jet printing method which perform printing by ejecting an ink from a plurality of ejection ports to a printing medium. In detail, the present invention relates to an ink jet printing apparatus and an ink jet printing method which perform printing using a printing head equipped with a plurality of ejection port arrays ejecting the same color ink.

2. Description of the Related Art

A printer or a copy machine and the like, a printing apparatus used as an output device for composite electronics, a work station including a computer or a word processor is configured so that printing can be performed on a printing medium such as paper or a plastic thin sheet based on printing information. The printing apparatus like this is classified into an ink jet type, a wire dot type, a thermal type, a laser beam type, or the like. The printing apparatus of the ink jet type among printing apparatuses of such various printing types uses an ink jet printing head (hereinafter, referred to also as a printing head) as a printing means to perform printing by ejecting an ink toward the printing medium from an ejection port provided in the printing head. The printing apparatus of such ink jet type (hereinafter, referred to also as an ink jet printing apparatus) has advantages that the printing head is easily downsized, that high resolution image can be formed rapidly, and that noise is small because of non-impact type.

The ink jet printing apparatus like this is roughly classified into two types of a serial type and a full line type depending on its printing method. The ink jet printing apparatus of the serial type uses a method to perform printing while scanning a printing head in a main scanning direction intersecting with a conveying direction of the printing medium (sub scanning direction). In this method, every time a printing movement in one time main scanning is finished, a movement in which the printing medium is conveyed by a predetermined amount is performed, and the printing on all regions of the printing medium is performed by repeating the printing movement and the conveyance of the printing medium. On the other hand, the ink jet printing apparatus of the full line type uses a printing method to perform only a movement of the printing medium in the conveying direction upon printing. In the full line type, the printing on all regions of the printing medium is performed by performing printing continuously for one line while conveying the printing medium by use of the printing head in which ejection ports are arranged across the entire width of the printing medium. The ink jet printing apparatus of such full line type uses a printing method having a capability of printing with higher speed in comparison with the serial type. For example, the printing with a resolution of 600×600 dpi (dot/inch) for the printing of mono-color such as a sentence, or a high resolution printing with a resolution of 1200×1200 dpi or more for the printing of full-color picture like a photon can be also performed at a high speed of 60 pages or more per minute on the printing medium sized A4.

In the ink jet printing apparatus of the full line type, each of the ejection ports that are arranged across the full width of printing region prints dots arranged along the conveying direction (a direction intersecting with this conveying direction is referred to as the main scanning direction hereinafter). Accordingly, as with so-called multi-path printing which performs one line printing with a plurality of scannings in the serial type, one line is printed with a plurality of ejection ports, therefore, a variation of ejecting characteristic between the ejection ports cannot be reduced. Because of this, when the ejecting characteristic has a variation such that ejecting is not performed normally, and that an impact location displaces, this type has a defect that a fault in the printing such as stripe or stripe unevenness may easily appear. Originally, it is to be desired that all ejection ports shall be manufactured with no defect and excellent accuracy. However, the number of the ejection ports is great; therefore, it is very hard to manufacture them with no defect and excellent accuracy. For example, for performing the printing with the resolution of 1200 dpi in a sheet sized A3, it is necessary to provide about fourteen thousand units of the ejection ports (printing width 297 mm) in the printing head of the full line type. Therefore, if they can be manufactured, manufacturing cost tends to increase because the non-defective ratio is low. Because of this, in the printing head of the full line type, a constitution of so-called connection heads so as to realize a long head by arranging relatively low cost short heads used for the printing of the serial type is commonly constructed in such a manner that a plurality of units are connected in an arrangement direction of the ejection ports.

As one constitution reducing a problem of the above-mentioned variation caused by the printing head of the full line type, in order to weaken an influence applied to the printing with one ejection port, a constitution in which dots on one line along the main scanning direction shall be printed by not one ejection port but a plurality of ejection ports is employed. This multi-array constitution of the ejection port arrays can realize printing of a high-quality picture by reducing the variation of the ejecting characteristic between the ejection ports as well as a multi-path printing in the printing of the serial type. For example, a picture quality of the same level as 4-path printing in the printing of the serial type can be realized in such a way that the ejection port array is constituted to be multiple as with a constitution in which 4-array ejection ports per one color are provided to be shifted in the conveying direction of the printing medium.

However, the present inventors examined and revealed that, when the printing is performed using the printing head of the multi-array constitution like this, uneven thickness with density varied with respect to the main scanning direction, so called conveyance unevenness tends to occur. Specifically, when the plural ejection port arrays arranged in a direction intersecting with the main scanning direction at approximately right angles are arranged with a certain distance in the conveying direction of the printing medium, it is found that the conveyance unevenness occurs remarkably as the distance between those ejection port arrays becomes great. This is caused by a phenomenon in which the printing medium may be conveyed meanderingly. At that time, the uneven thickness may occur in such a way that the impact location displaces depending on a difference of eject timing between the ejection port arrays.

FIG. 16 is a drawing illustrating a situation performing the printing on a printing medium 5 conveyed in the arrow direction in the drawing with a printing head of 4-array constitution (array A, array B, array C, and array D) for the same ink color. Further, FIG. 17 is a graph showing a printing displacement (hereinafter, also referred to as X displacement) caused in such a manner that the printing medium is conveyed meanderingly in a state like a sine curve when the printing is performed with the printing head shown in FIG. 16.

As is apparent from FIG. 16, each of four ejection port arrays is arranged mutually in parallel with a fixed interval in the main scanning direction. In addition, a row direction of four ejection port arrays is equivalent to the conveying direction of the printing medium. Accordingly, when the printing is performed with ejection ports of four ejection port arrays, printing timing is different for each array. Incidentally, a dot of the same color is not printed to be overlapped so often at the same location of the printing medium. Normally, the dots are printed in order with four ejection ports so that they may be adjacent in the main scanning direction with a pitch depending on the resolution. However, since a mutual spacing between these four ejection port arrays is far greater than the pitch of the above-mentioned adjacent dots, hereinafter, a location at which the dots are printed adjacently in the main scanning direction with these plural ejection ports is described as the same location for simplified description. When the printing is performed at the same location like this, ejection timing is different for each ejection port array, and a printing displacement of each ejection port array caused by the difference leads to a condition that phase is shifted as shown in FIG. 17.

A relation between a graph in FIG. 17 and a result of the printing will be described. In any graph of the arrays from the array A to the array D, there is X-displacement within a range from +15 μm to −15 μm so as to draw a sine (sine wave) curve, and the phase is shifted by the amount corresponding to the difference in ejection timing. Regarding printing result, the printing result of the case in which a straight line is drawn without displacement in X is most preferable, and the uneven thickness does not occur either.

By the way, a portion in which a difference of X displacement among ejection port arrays in each graph shown in FIG. 17 is small is each of inflection points of Q1, Q2, Q3, and Q4, and the printing results equivalent to portions near these inflection points Q1, Q2, Q3, and Q4 give almost excellent printing results. Further, in portions except the inflection points, namely, notwithstanding from plus to minus or from minus to plus, P1, P2, P3, and P4 which are large in X displacement variation amount, the printing becomes rough as a result that the impact location of the ink ejected is displaced. Accordingly, the printing result becomes a result with prominent uneven thickness in which dense portion and rough portion are generated alternately.

FIG. 18 shows that a difference of the X displacement between the array A and the array D and a difference of the X displacement between the array A and the array B in each main scanning position in FIG. 17 are represented in a graph. The comparison of FIG. 17 and FIG. 18 shows that the difference of the X displacement becomes small at a portion equivalent to the inflection points Q1, Q2, Q3, and Q4 in FIG. 17. The comparison also shows that the difference between the array A and the array B, which are short in distance between the ejection port arrays is smaller than the difference between the array A and the array D, which are long in distance between the ejection port arrays. Namely, the shorter the distance between the ejection port arrays becomes, the less the uneven thickness becomes. Inversely, since the longer the distance between the ejection port arrays becomes, the greater the X displacement becomes, the uneven thickness is generated remarkably accordingly. In particular, in a photographic output in which high image quality is required, the uneven thickness like this becomes an unacceptable level.

As mentioned above, the shorter the distance between the ejection port arrays becomes, the less the uneven thickness becomes. Namely, the uneven thickness generated in the printing result can be normally eliminated by performing the printing with one ejection port array. However, in this case, an effect of so called multi-array constitution, in which when a certain ejection port has a failure of miss ejecting, other ejection port performs supplemental ejecting, can not be obtained, therefore, the printing result with high quality printing can not be obtained.

By the way, the uneven thickness generated in the printing result is conspicuous in the half tone portion in particular. Since the half tone portion has a gradation in which the dots impacted per a unit area are contacted or overlapped each other, when the impact location displaces, a variation of covering ratio (called [area factor] also) of the ink with respect to the unit area of the printing medium is greater in comparison with that of the other gradation. Therefore, the impacted dot with displacement is likely to be visible. As compared with the above, since the dots are separately arranged normally in a portion in which the number of impacting dots per the unit area is small, the variation of the covering ratio is hard to occur even when the impact location displaces. On the other hand, since the dots are densely impacted being mutually overlapped in a portion in which the number of the impacting dots per the unit area is large, the variation of the covering ratio is hard to occur because an influence of the impact location displacement is hard to be received.

Incidentally, a meandering in the printing medium conveyance causing the above-mentioned problem, needless to say, needs not be a complete sine wave curve as mentioned above. Further, even when the meandering is generated in a part of the conveyance, it is evident that the above-mentioned problem is caused in that part.

Furthermore, the above-mentioned uneven thickness can be thought to be naturally eliminated by suppressing a conveyance deviation of the printing medium as much as possible. However, the deviation generated on the apparatus like this is hard to be eliminated completely. Therefore, the displacement of several 10 μm or so tends to be generated while conveying the printing medium. On the other hand, as the distance between the plural ejection port arrays is made to be shortened relatively, the uneven thickness becomes not conspicuous because a location displacement influence of the impacting is reduced. However, the distance between the ejection port arrays is hard to be shortened from a consideration of arrangement of the ejection port, a wiring layout of the printing element provided in the ejection port, securement of a space portion in which the ink jet printing head and a cap protecting the ink jet printing head may contact each other, and the like.

SUMMARY OF THE INVENTION

The present invention provides an ink jet printing apparatus and an ink jet printing method, which enable high quality printing suppressing uneven thickness in a conveying direction using a printing head having a plurality of ejection port arrays.

An ink jet printing apparatus for printing an image on a printing medium by ejecting ink from a printing head based on image data, the printing head having a plurality of ejection port arrays each having a plurality of ejection ports capable of ejecting the same color ink arranged along a first direction, the plurality of ejection port arrays being arranged in a second direction intersecting with the first direction, wherein according to gradation information on the image data, distribution ratios of the image data with respect to the plurality of ejection port arrays are made to be different from one another.

An ink jet printing method for printing an image on a printing medium by ejecting ink from a printing head based on image data, the printing head having a plurality of ejection port arrays each having a plurality of ejection ports capable of ejecting the same color ink arranged along a first direction, the plurality of ejection port arrays being arranged in a second direction intersecting with the first direction, wherein according to gradation information on the image data, distribution ratios of the image data with respect to the plurality of ejection port arrays are made to be different from one another.

According to the present invention, printing is performed by making distribution ratios of printing of each ejection port array in the printing head different from one another based on gradation. This enables obtaining an image quality improvement effect by multiple ejection port arrays, and also obtaining a high grade printing result with generation of uneven thickness in a half-tone region being suppressed.

Further features of the present invention will become apparent from the following description of exemplary embodiments with reference to the attached drawings.

DESCRIPTION OF THE EMBODIMENTS

First Embodiment

Hereinafter, a first embodiment of the present invention will be described in detail by referring to the figures.

(Entire Constitution)

Figure 1:
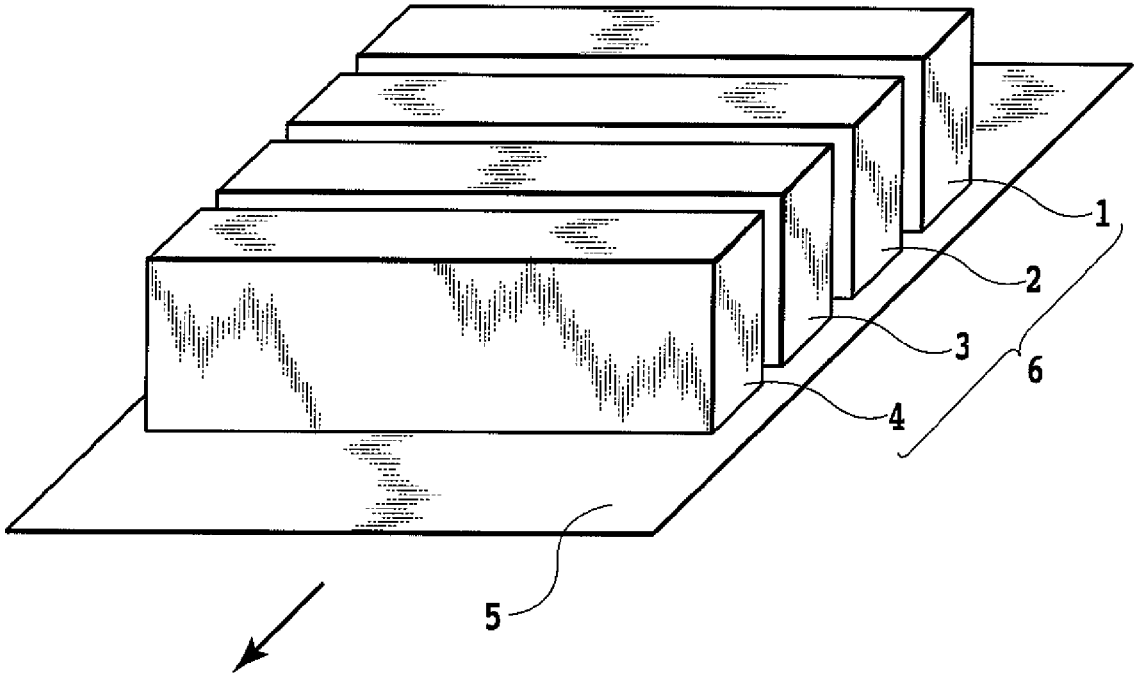
FIG. 1 is a perspective view showing a constitution of an ink jet printing apparatus according to a first embodiment.

FIG. 1 is a perspective view showing a conceptual constitution of an ink jet printing apparatus relating to one embodiment of the present invention. A head unit 6 is constituted by a plurality of long printing heads 1, 2, 3, and 4, and a plurality of ejection ports equipped with printing elements therein (not shown) is provided in each of the printing heads 1, 2, 3, and 4. The printing heads 1, 2, 3, and 4 are the long printing heads for ejecting inks of black (K), cyan (C), magenta (M), and yellow (Y), respectively. An ink supply tube not shown is connected to each of the printing heads 1, 2, 3, and 4, and furthermore, control signals and the like are sent through a flexible cable not shown.

A printing medium 5 such as plain paper or high quality exclusive paper, OHP sheet, glossy paper, glossy film, and postal card is conveyed in an arrow direction (main scanning direction) with driving of a conveyance motor while being sandwiched by conveyance rollers, paper ejecting rollers or the like not shown. When the printing is performed, each of the printing heads 1, 2, 3, and 4 of the present embodiment is in a state of being fixed without changing the position, and the printing is performed with a relative movement between the printing head and the printing medium by moving the printing medium 5 only.

In a liquid passage communicating with the ejection port, a heater element (electric/thermal energy converter) generating thermal energy utilized for ink ejecting is provided. The heat of this heater element causes film boiling of the ink, and the ink is ejected from the ejection port by a pressure of air-bubble generated at that time. When performing the printing, the ink is adhered on the printing medium 5 by ejecting ink droplets from the ejection port in such a way that the heater element is driven based on a printing signal in time with a reading timing of linear encoder (not shown) detecting a conveyance position of the printing medium 5. A picture or character can be printed by the ink droplets impacted on the printing medium 5.

The printing heads 1, 2, 3, and 4 are sealed in a formation face of the ejection port with a cap portion of a capping means (not shown) when the printing is not performed. This prevents an adhesion of the ink caused by an evaporation of solvent contained in the ink, or a clogging of the ejection port caused by a foreign body such as dust. The cap portion of the capping means can also be utilized for an empty ejecting (also called preliminary ejecting) for solving an ejection failure or clogging of the ink ejection port due to a low frequency of use, namely, for ejecting the ink not contributed to the printing toward the cap portion from the ink ejection port. Furthermore, the ejection port with ejection failure can be recovered by introducing a negative pressure generated by a pump (not shown) within the cap portion conditioned in capping to absorb and eject the ink not contributed to the printing of the picture from the ejection ports of the printing head. Also, the formation face of the ink ejection port in the ink jet head can be cleaned (wiped) by arranging a blade (wiping member) (not shown) in a position adjacent to the cap portion.

Figure 2:
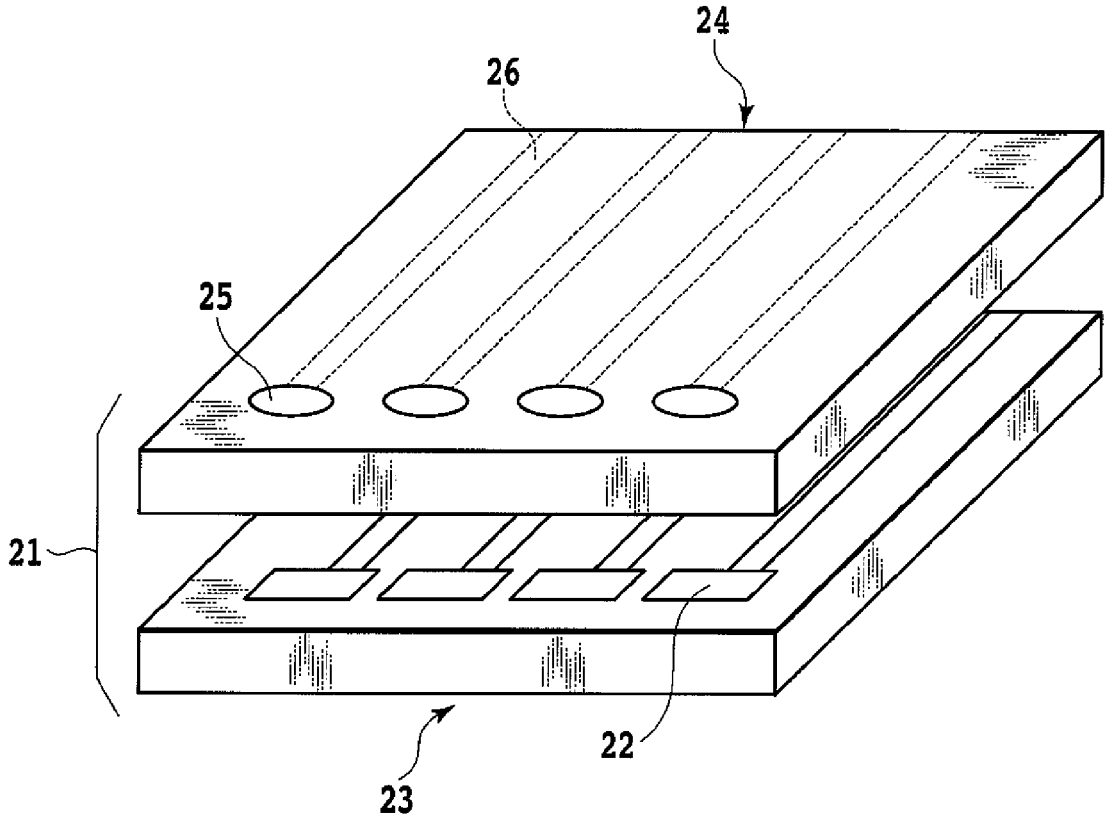
FIG. 2 is an exploded perspective view showing a constitution of an essential part of printing head of the ink jet printing apparatus of FIG. 1.

FIG. 2 is an exploded perspective view showing a constitution of an essential part of the printing heads 1, 2, 3, and 4. An ink jet printing head 21 is constituted, as major members, by a heater board 23 being a substrate in which a plurality of heaters (heater elements) 22 for heating the ink is formed, and a top plate in which a plurality of ejection ports 25 corresponding to the heaters 22 of this heater board 23. In the top plate 24, tunnel-like liquid passages 26 communicating with each of ejecting ports 25 is formed, and the liquid passages 26 are connected to one ink liquid chamber (not shown). Furthermore, the ink is supplied to the ink liquid chamber through an ink supply port (not shown), and the supplied ink is supplied to each liquid passage 26 from the ink liquid chamber. In FIG. 2, four units of the ejection port 25, heater 22, and liquid passage 26 are shown in representation, and the heaters 22 are arranged one by one by corresponding to respective liquid passages 26. In the ink jet head 21 assembled as shown in FIG. 2, the ink on the heater 22 is boiled to form air bubbles by supplying a predetermined drive pulse to the heater 22, and the ink is pushed out and ejected from the ejection port 25 by a volume expansion of the air bubbles.

Furthermore, an ink jet printing method to which the present invention can be applied is not limited to only the bubble jet (trademark) method using the heater element shown in FIG. 1 and FIG. 2. For example, the present invention can be applied to an ink ejecting method such as a charge control type, or divergence control type in the case of continuous type ejecting the ink droplets continuously, or to a pressure control method of ejecting the ink droplets using piezoelectric vibration elements in the case of on-demand type ejecting the ink droplets as needed. As described above, the present invention can be applied to the printing head equipped with various ink jet printing elements.

Figure 3:
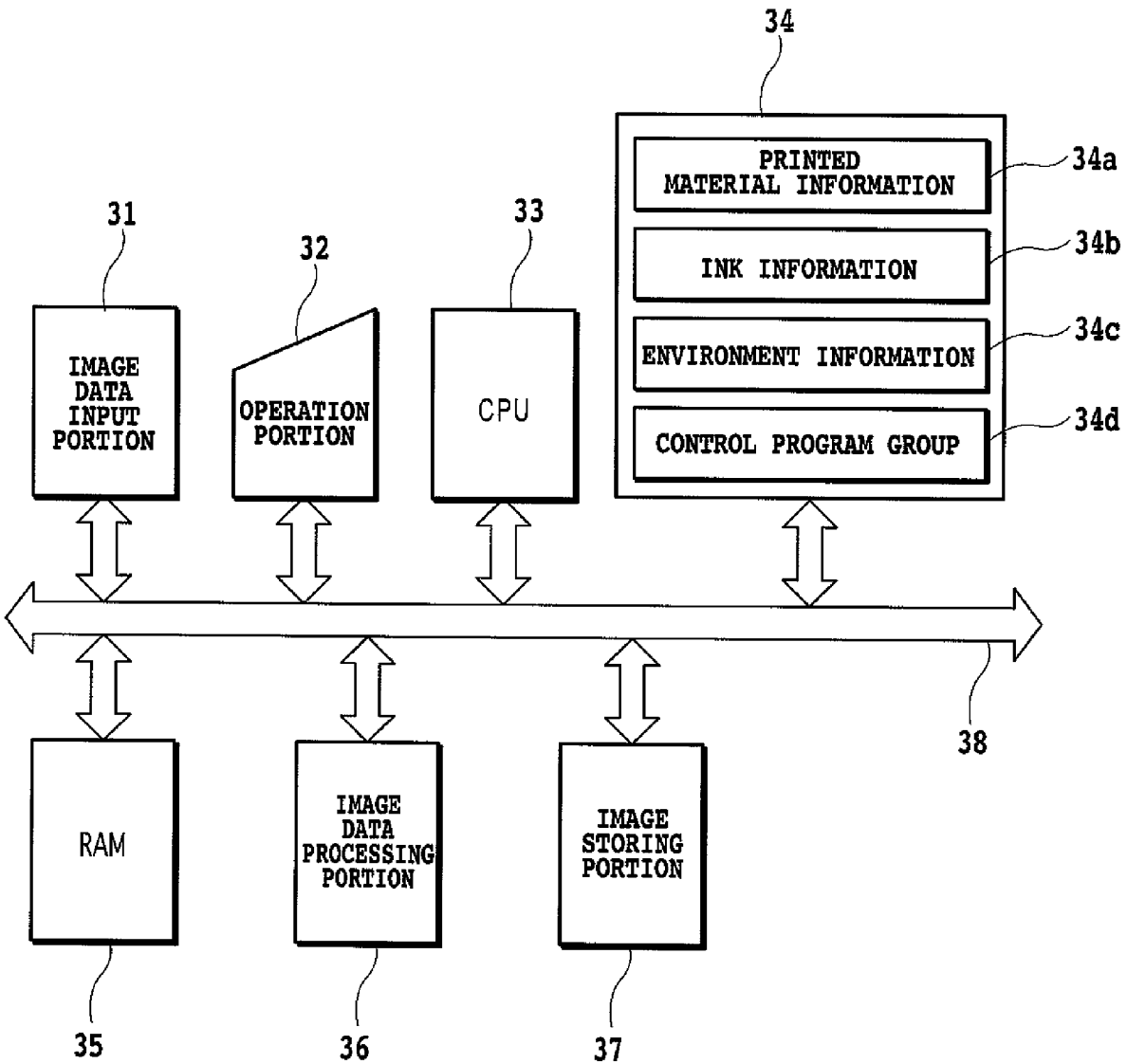
FIG. 3 is a block diagram showing a constitution example of control system in the ink jet printing apparatus of FIG. 1.

FIG. 3 is a block diagram showing a constitution example of control system in the ink jet printing apparatus of the present embodiment. A reference numeral 31 denotes an image data input portion, 32; a control portion, 33; a CPU portion performing various processes, and 34; a storage medium storing various data. In a print information storing memory of the storage medium 34, information 34*a* chiefly regarding sorts of the printing medium, information 34*b* regarding the ink used for printing, and information 34*c* regarding atmosphere such as temperature, moisture at the time of printing. A reference numeral 34*d* denotes various control program group. Furthermore, 35 is a RAM, 36 is an image data processing portion, 37 is an image printing portion outputting images, and 38 is a bus portion transferring various data.

As mentioned in further detail, into the image data input portion 31, multi-value image data from an image input apparatus such as a scanner, or a digital camera, or the multi-value image data stored in a hard disk of personal computer or the like is input. The control portion 32 includes various keys setting various parameters and instructing a start of the printing. The CPU 33 controls the whole of the present printing apparatus according to various programs in the storage medium. The storage medium 34 stores a program and the like for operating the present printing apparatus according to a control program, or an error processing program. All operations of the present examples are controlled by this program. As the storage medium 34 storing the program like this, a ROM, an FD, a CD-ROM, an HD, a memory card, and a magnetic optical disc can be utilized. The RAM 35 is used as a work area of various programs in the storage medium 34, a temporary save area at the time of error processing, and a work area at the time of image processing. Furthermore, after various tables in the storage medium 34 are copied to the RAM 35, the tables are modified, and an image processing can be advanced while referring to the modified tables.

The image data processing portion 36 quantizes the input multi-value image data into an N-value image data for each pixel. Subsequently, based on a gradation value "N" indicated by each quantized pixel, a dot arrangement pattern corresponding to the gradation value is selected. Since this dot arrangement pattern is a binary pattern indicating presence of a dot print, a binary ejection data can be obtained by selecting the dot arrangement pattern. In this manner, after performing N-value processing on the input multi-value image data, the image data processing portion 36 generates the binary ejection data based on the N-value image data. For example, when the multi-value image data represented by eight bits (256 gradations) is input into an image data input portion 31, a gradation value of the image data output in the image data processing portion 36 is quantized into, for example, 25 (=24+1) values. Subsequently, in the image data processing portion 36, the dot arrangement pattern is assigned to the 25-value image data, and thereby the binary ejection data indicating the presence of ink ejection is generated. After that, the binary ejection data is distributed to a plurality of ejecting port arrays, and a binary ejection data corresponding to an ejection port of each ejecting port array is determined. Furthermore, in the present example, although a multi-value error diffusion method is used for N-value processing of an input gradation image data, not limited to this, for example, a mean density reservation method, a dither matrix method, or any half tone processing method can be used. In addition, the image data processing portion 36 has only to generate the binary ejection data finally from the multi-value image data, and as mentioned above, the N-value processing is not always required to be applied. For example, the binary processing in which the multi-value image data input into the image data processing portion 36 is directly converted into the binary ejection data may be performed. An image printing portion 37, based on the binary ejection data generated in the image data processing portion 36, ejects the ink from the corresponding ejection port 25 to form a dot image on the printing medium. The bus line 38 transmits an address signal inside the present apparatus, the data, and the control signal.

Next, an arrangement of the ejection port and its drive, and an actual printing movement using the printing head are described. In the present embodiment, the binary ejection data to be printed with the printing heads per ink color is generated in such a way that the input image data is subjected to color separation so as to correspond to the printing head per ink color, and each color multi-value image data subjected to the color separation is binary-processed by the error diffusion method.

Figure 4:
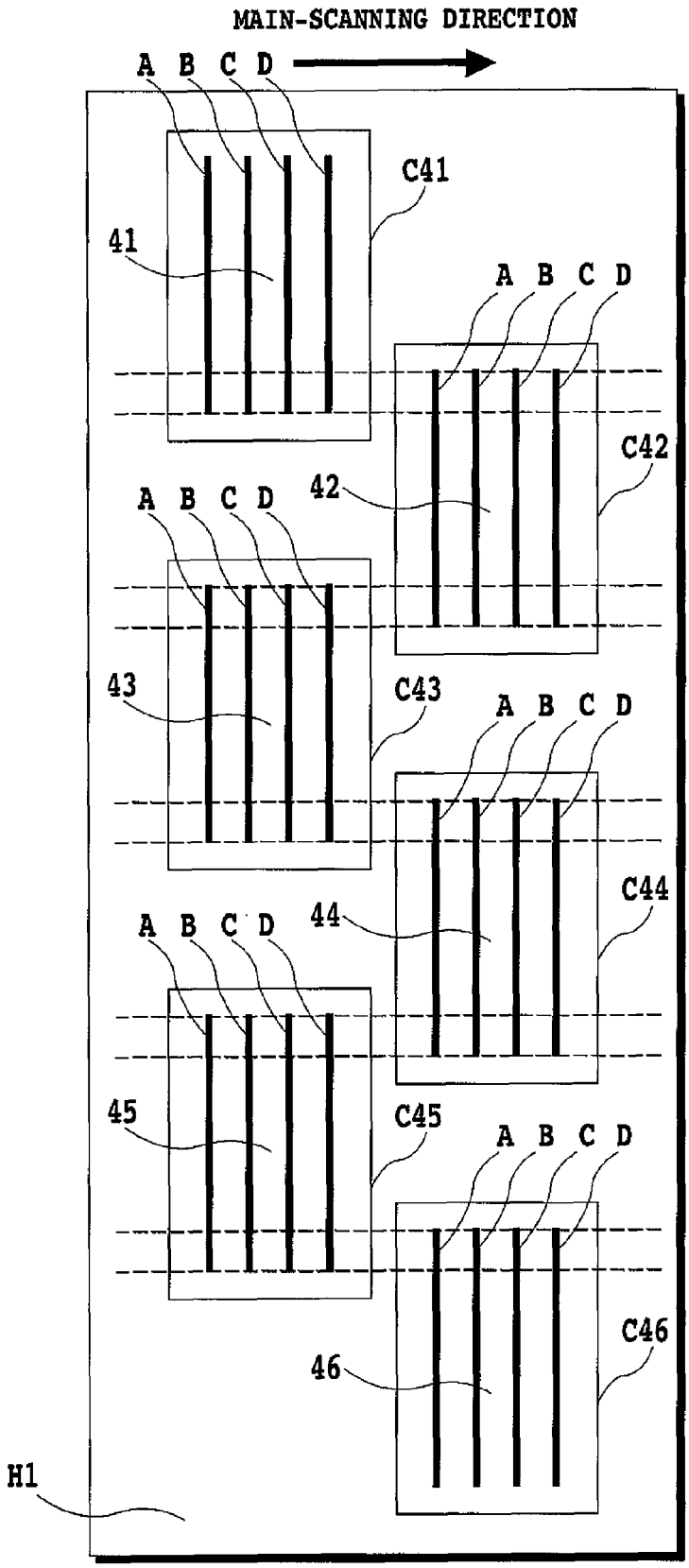
FIG. 4 is a schematic view showing a constitution of long printing head of full line type to which the present invention can be applied.

FIG. 4 is a schematic view showing a constitution of a long printing head H1 of the full line type to which the present invention can be applied. The long printing head H1 of the present embodiment is constituted from chip-like constituent components (hereinafter, merely referred to as a chip) C41, C42, C43, C44, C45, and C46 relatively short in length in an ejection port arrangement direction (a first direction). The ejection port arrays A, B, C, and D are formed in such a manner that a plurality of ejection ports is arranged along the ejection port arrangement direction (first direction) intersecting with the main-scanning direction (second direction) in each chip. The long printing head H1 is formed by arranging the chips like this in zigzag manner in the ejection port arrangement direction (first direction). Since each chip of C41, C42, C43, C44, C45, and C46 is formed in the same constitution, the constitution is described using the chip C41 as an example. The chip C41 includes four ejection port arrays (array A, array B, array C, and array D), and each array has a plurality of ejection ports arranged with a resolution of 1200 dpi. Furthermore, the ejection ports of the ejection port arrays adjacent to each other (for example, the array A, and the array B) in the main scanning direction (second direction) intersecting with the ejection port arrangement direction (first direction) are provided in a condition in which the arrangement pitch is shifted by a half pitch in the ejection port arrangement direction. Namely, the ejection ports of the ejection port arrays adjacent to each other are arranged in a condition in which ejection ports of one ejection port array are positioned being shifted by $1/2400$ inch from the ejection ports of adjacent ejection port arrays each other along the ejection port arrangement direction. Accordingly, since the adjacent ejection port arrays themselves are made to print different rasters shifted in the ejection port arrangement direction by $1/2400$ inch, a printing resolution in the ejection port arrangement direction becomes 2400 dpi. On the other hand, printing of the same raster is executed with a combination of the array A and the array C or a combination of the array B and the array D, and the printing resolution with respect to the same raster becomes 1200 dpi. In detail, a raster (a first raster) printed by the combination of the array A and the array C is a raster in which the printing is performed by only odd columns, and the printing resolution is 1200 dpi. Further, a raster printed by the combination of the array B and the array D is a raster in which the printing is performed by only even column, and the printing resolution is also 1200 dpi. In this manner, since the printing resolution of each of the odd columns and the even columns is 1200 dpi, respectively, combining both columns gives the printing resolution of 2400 dpi. Incidentally, since the first raster and the second raster exist alternatively in the ejection port arrangement direction, the resolution in the main-scanning direction is defined by treating these adjacent two rasters as one set. By the constitution above, a resolution of 2400 dpi in the main-scanning direction (conveyance direction), and a resolution of 2400 dpi in the sub-scanning direction (ejection port arrangement direction) can be realized as the printing resolution.

Figure 5:
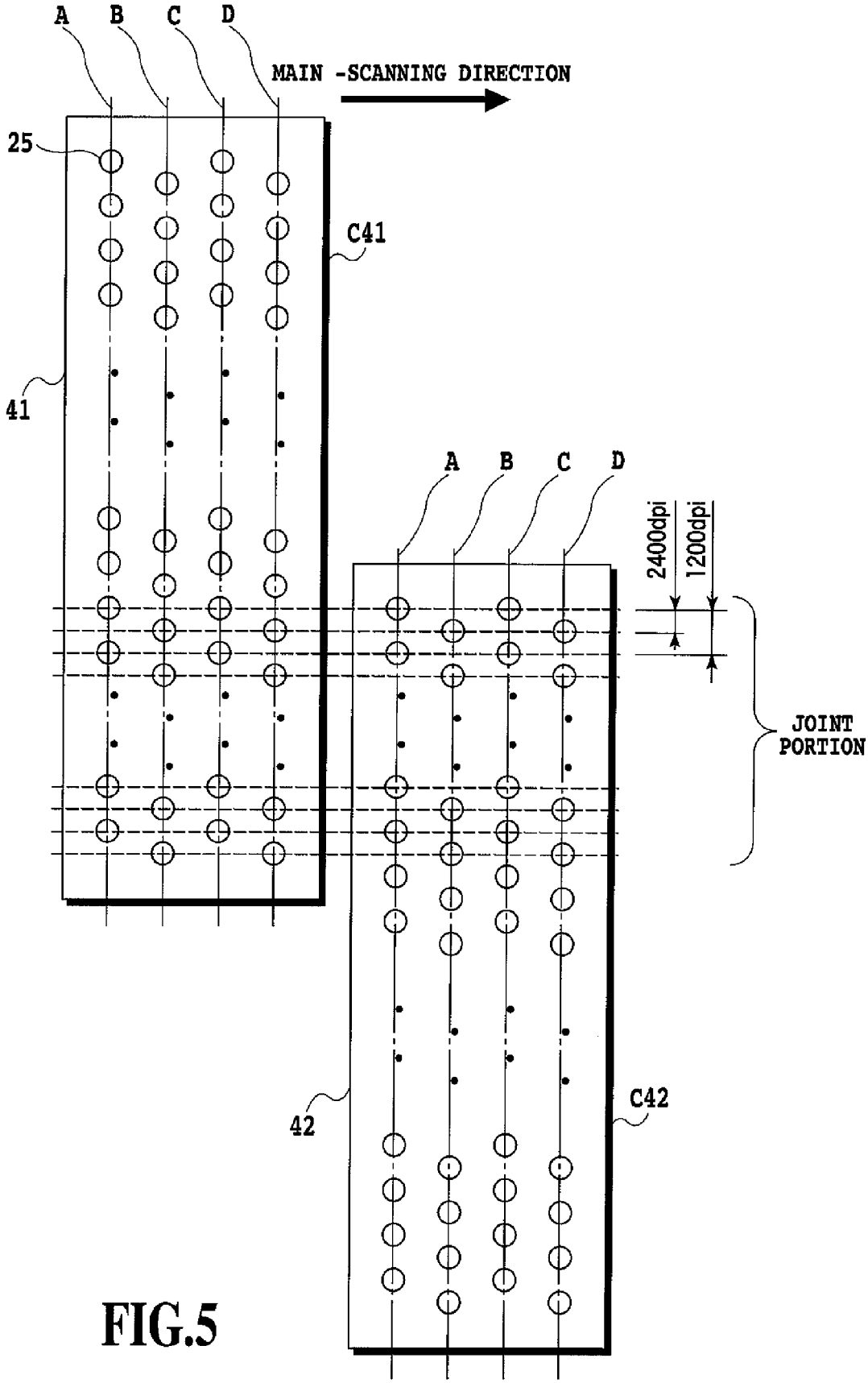
FIG. 5 is a schematic diagram showing in detail a condition of ejection port arrays of chips of FIG. 4.

FIG. 5 is a schematic diagram showing in detail a condition of the ejection port arrays of the chip C41 and the chip C42. As shown in FIG. 5, the chip C41 and the chip C42 are arranged so that predetermined ejection ports may overlap each other in the scanning direction (this overlapped portion is called a joint portion, on the other hand, a portion other than the joint portion is called a non-joint portion). The arrangement like this prevents white stripes on the printing medium corresponding to a location of joint between chips themselves from being generated. In the present embodiment, the ejection ports between the chip C41 and the chip C42 are arranged so that the ejection ports from a port positioned at an end in the ejection port arrays to the ejection ports of 32 units may overlap each other in the ejection port array direction.

(Characteristic Constitution)

Figure 6:
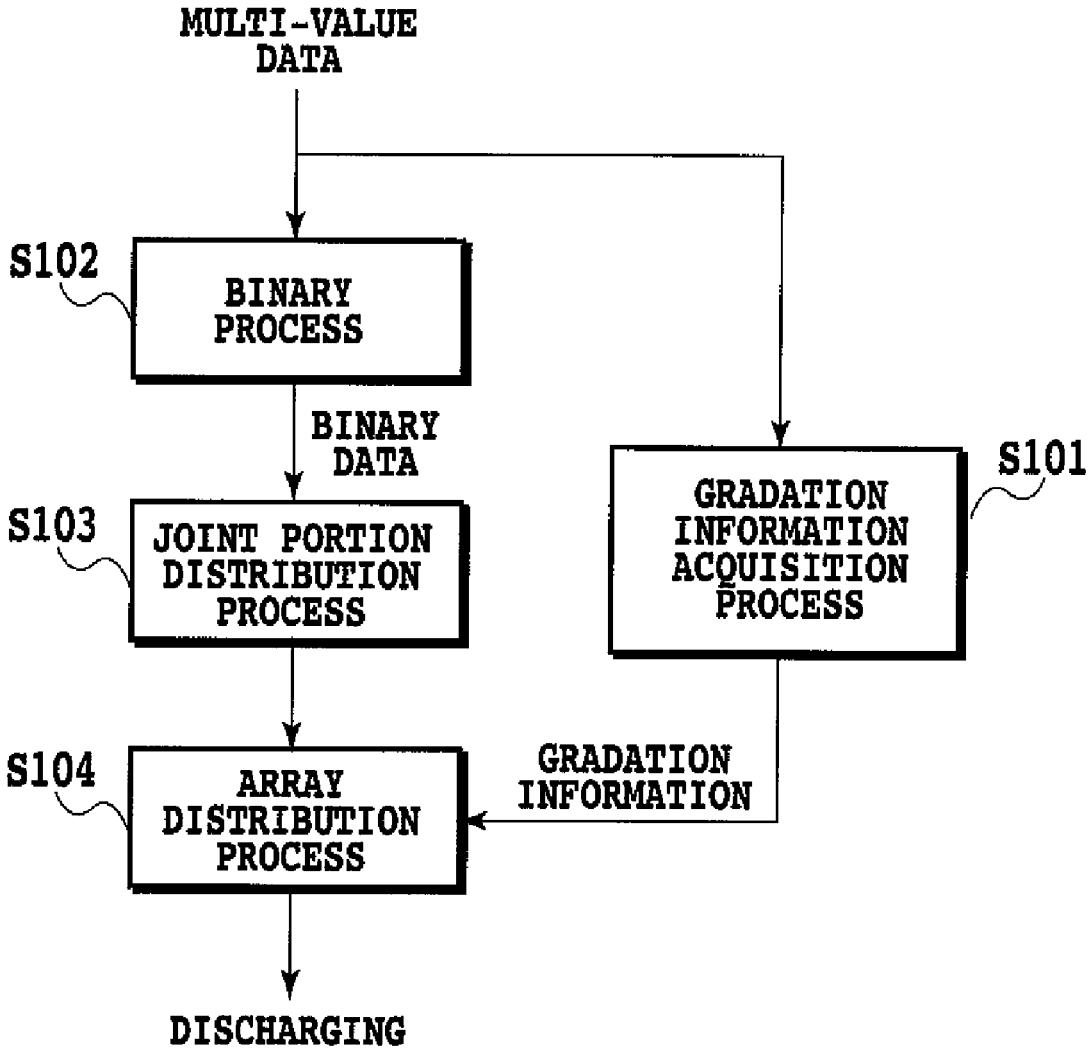
FIG. 6 is a flowchart showing image data processing in the first embodiment.

FIG. 6 is a flowchart of image data processing in the present embodiment. According to this flowchart, printing ratios of four ejection port arrays are determined by distributing the binary ejection data to the four ejection port arrays A to D. Here, the printing ratio of the ejection port arrays means a ratio of printing amount of each ejection port array with respect to the printing amount on the printing medium by all ejection port arrays. Incidentally, a flowchart shown in FIG. 6 is executed in the image data processing portion 36 under a control of CPU 33.

Figure 8:
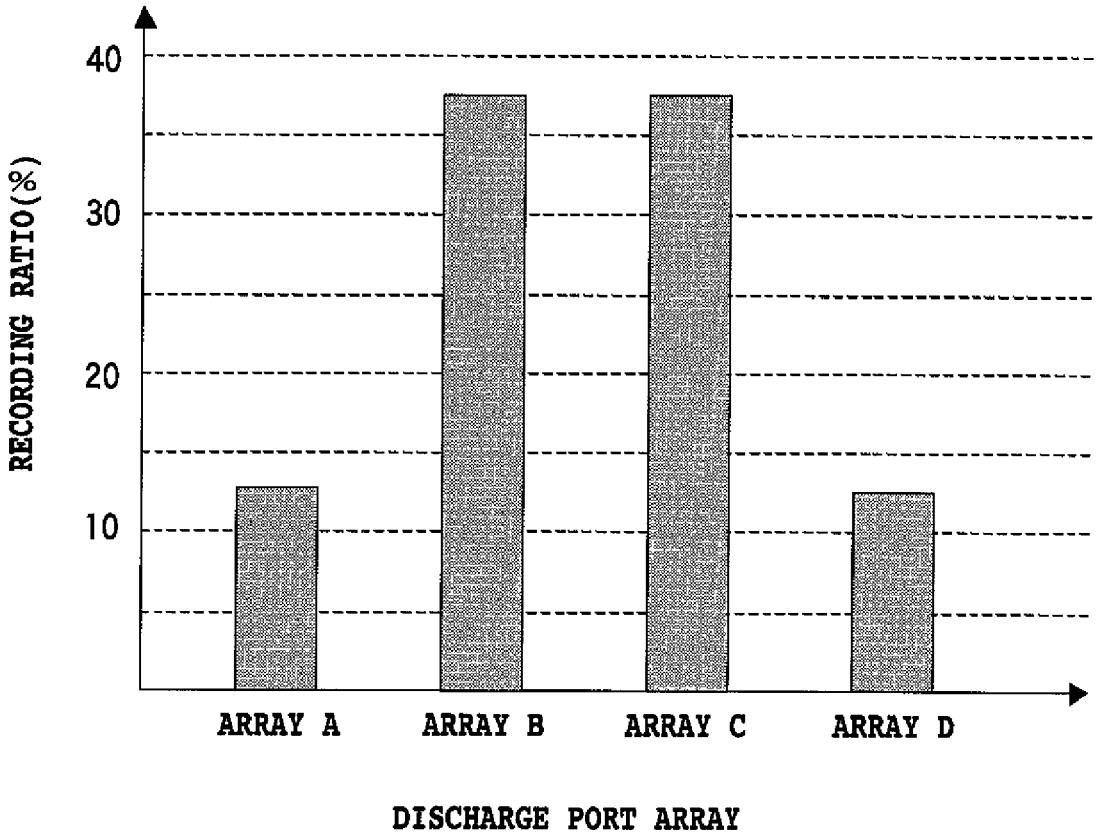
FIG. 8 is a diagram showing a data assigning ratio with respect to each ejection port array when a half tone portion is printed in the chip of FIG. 4.

First, in a gradation information acquisition process of step S101, based on multi-value data divided for each head, gradation information used in an array distribution process of step S104 is obtained. In detail, the gradation information indicated by any one of a bright portion, a half tone portion, and a dark portion is obtained by dividing the multi-value data indicated by 256 gradations of 0-255 into 3 groups of the bright portion (0-85), the half tone portion (86-170), and the dark portion (171-255). On the other hand, in step S102, the multi-value data as same as that in step S101 is given as input, and binary process is performed. As for a binary process method, although the method can be any method such as the error diffusion method or an INDEX development method, here as mentioned above, the multi-value data is quantized into the N-value data by the error diffusion method, and a binary process is performed by assigning the dot arrangement pattern to the N-value data. In step S103, a process of distributing the binary data with respect to the ejection port constituting a joint portion between chips is performed. Here, the data is evenly distributed with respect to the eight ejection port arrays constituting the joint portion. For example, the joint portion between the chip C41 and the chip C42 is constituted by the total eight arrays consisting of four arrays of A-D of the chip C41 and four arrays of A-D of the chip C42, and the binary data is distributed at a rate of 12.5% with respect to these eight arrays, respectively. This determines which ejection port performs the printing in the joint portion (overlap portion) between respective chips, such as between chips C41-C42 (referred to FIG. 5) as a first example. Here, although the data is evenly distributed with respect to each array constituting the joint portion, the data can be unevenly distributed in a way as shown in FIG. 8. In any case, in step S103, the binary ejection data corresponding to the joint portion has only to be distributed to each array according to a predetermined assigning ratio without considering the gradation information obtained in step S101. On the other hand, in step S104, a process of distributing the binary data with respect to each of ejection port arrays A-D constituting the non-joint portion is performed. This process determines printing ratios of four arrays (distribution ratios). Here, each distributing ratio of the array A and the array D is 12.5%, and each distribution ratio of the array B and the array C is 37.5%.

Figure 7:
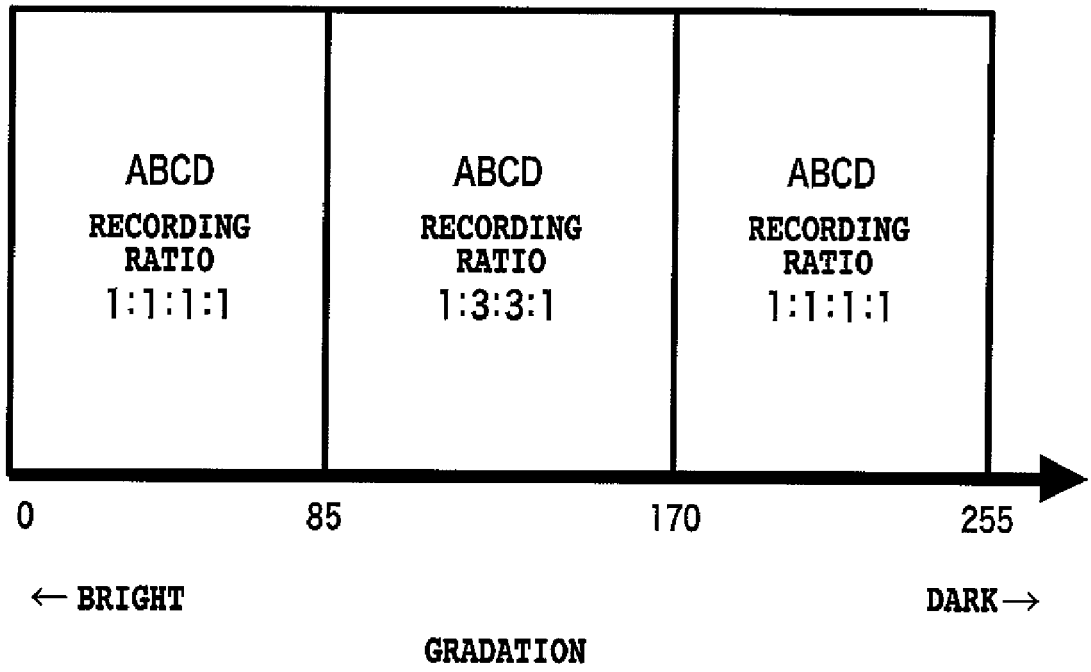
FIG. 7 is a diagram showing gradation information in an array distribution process, and a distribution ratio of the ejection port arrays corresponding to the gradation information.

FIG. 7 is a diagram showing gradation information in an array distribution process shown in step S104 of FIG. 6 and the distribution ratios of the array A, the array B, the array C, and the array D corresponding thereto. In an example here, all 256 gradations are divided into 3 groups of the bright portion (gradation values 0-85), the half tone portion (gradation values 86-170), and the dark portion (gradation values 171-255), and different array distribution ratios are applied for each gradation.

The present invention is characterized in that as described above, the printing is performed by making the array distribution ratios different depending on the gradation. In particular, the present embodiment is characterized in that the different distribution ratios are set in a condition between the case of specific gradation information (gradation exhibiting the halftone), and the case of gradation information except the specific gradation information (gradations indicating the bright portion and the dark portion).

Figure 17:
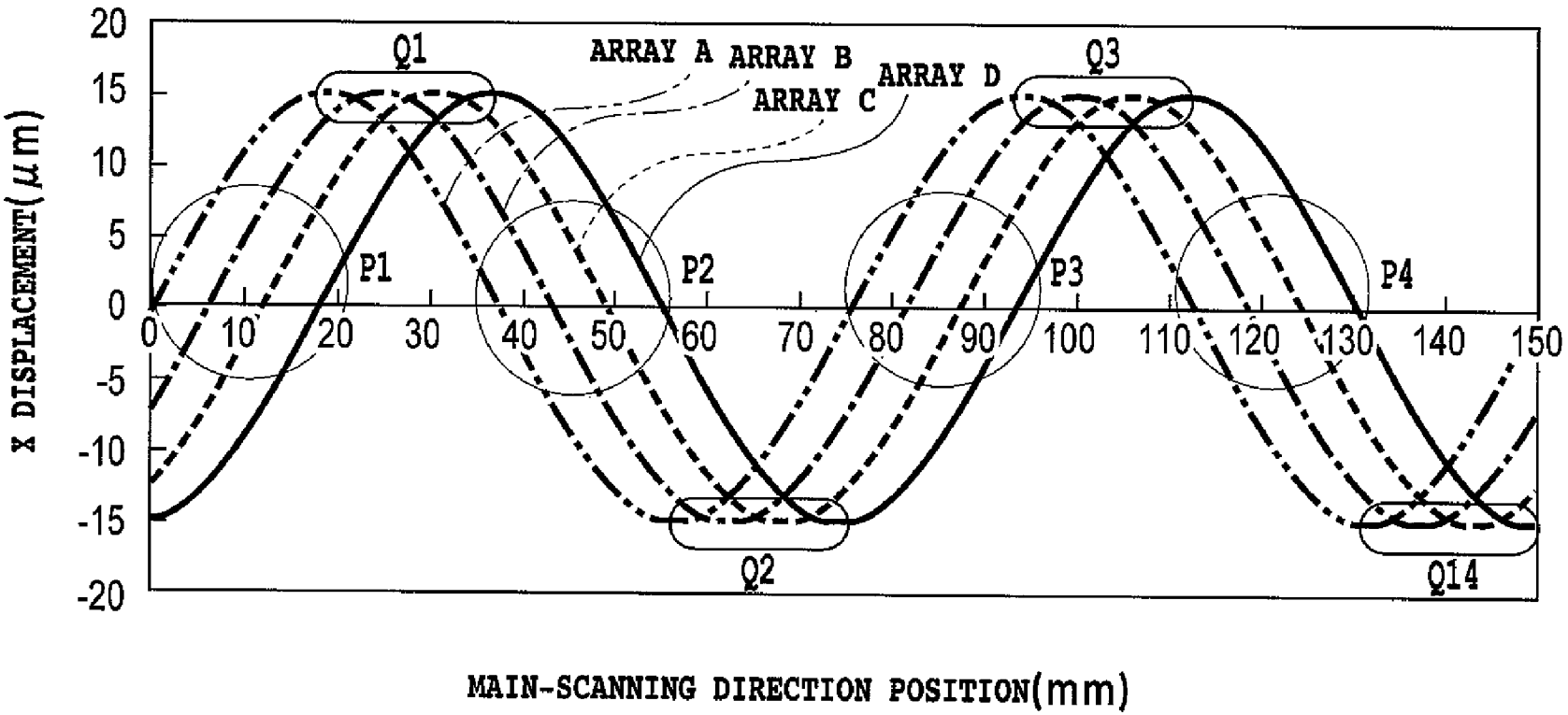
FIG. 17 is a graph showing printing displacement caused by meandering conveyance of the printing medium when printed with the printing head shown in FIG. 16.
Figure 18:
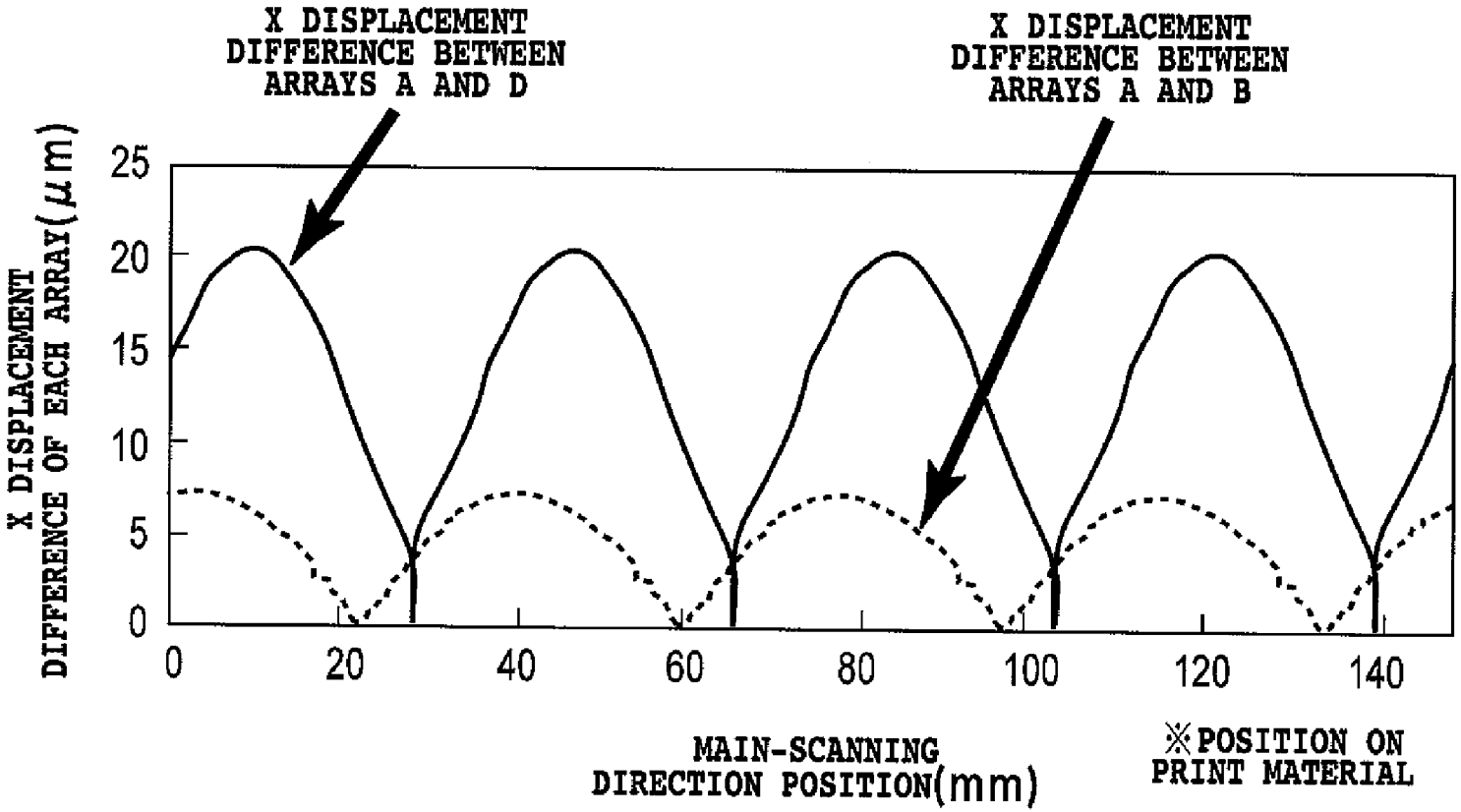
FIG. 18 is a diagram showing a difference of the printing displacement between nozzle-arrays themselves in each main scanning position of FIG. 17.

FIG. 8 is a graph showing a data assigning ratio (printing ratio) with respect to each ejection port array when printing the half tone portion with the non-joint portion of the chip of the present embodiment. As apparent from the graph, the data assigning ratio for each array of the present embodiment is set to be the array A:the array B:the array C:the array D=1:3:3:1. In a process of the data, the data is distributed so that this ratio may be obtained when the image data after the binary process (binary ejection data) is assigned to each array. By changing a data assigning ratio for each ejection port array like this, a ratio of dots printed by specific ejection port arrays (here, the ejection port array B and the ejection port array C) becomes great. As a result, an impact displacement of the dot printed by the different ejection port array as described in FIG. 17 becomes less, and a generation of the uneven thickness as described in FIG. 17 can be suppressed. In particular, in the case of FIG. 8, since distribution ratios of both end arrays A, D with a large distance between the ejection port arrays are set to be relatively low, and distribution ratios of central arrays B, C with a small distance between the ejection port arrays are set to be relatively high, the uneven thickness can be suppressed as described in FIG. 18. In addition, in the case of FIG. 8, since the ejection data is distributed not only to a single ejection port, but also to a plurality of ejection port arrays A-D, the so-called multi-pass effect that one raster is printed by a plurality of ejection ports can be also obtained.

Figure 9:
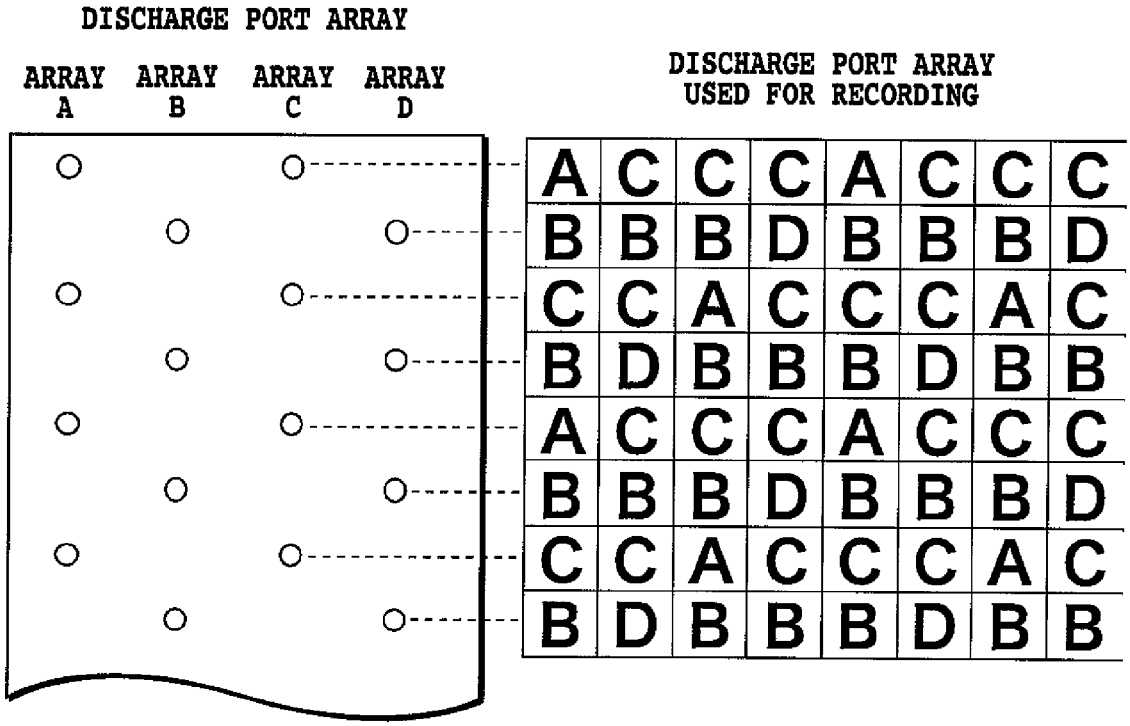
FIG. 9 is a diagram showing a mask for realizing a data distribution of FIG. 8.

FIG. 9 is a diagram showing a specific example of mask so as to realize the data distribution of FIG. 8 by associating with the ejection port arrays of the head. A right side in diagram is an image diagram of mask showing that the data is distributed to which ejection port array among A, B, C, and D for each pixel location, and when [A] is applied, the data distribution is performed to the ejection port array A. The data is distributed according to the data assigning ratio as mentioned above, and therefore, in a raster (first raster) in which the printing is performed by the array A and the array C as shown in the figure, after the distribution is performed once to the ejection ports of the array A, the distribution is set to be performed continuously three times to the ejection ports of the array C. Similarly, in a raster (second raster) in which the printing is performed by the array B and the array D, after the distribution is performed once to the ejection ports of the array D, the distribution is set to be performed continuously three times to the ejection ports of the array B. This reduces a ratio that dots themselves printed by the arrays with a long interval (for example, the array A and the array C) are adjacent in such a way that a continuous printing performed by the array C or the array B is made to be increased. This can realize the printing in which the number of portions with impact locations displaced is small. Here, in FIG. 9, printing locations in main-scanning directions of the first raster and the second raster are described as if they are the same. However, as mentioned above in reality, the printing locations in the main-scanning directions of the first raster and the second raster are displaced by one column, and the first raster is a raster in which odd columns are printed, and the second raster is a raster in which even columns are printed. Accordingly, in FIG. 9, a mask portion corresponding to the first raster (portions denoted by A and C) indicates a distribution destination of the ejection data corresponding to the odd columns. Similarly, a mask portion corresponding to the second raster (portions denoted by B and D) indicates a distribution destination of the ejection data corresponding to the even columns.

By the way, using only the array C and the array B can be thought to realize the printing with less displacement of the impact location when printing the image data indicating the half tone. However, in that case, when a failure ejection port is generated in the array C or the array B, a raster corresponding to the failure ejection port cannot be printed. When the failure ejection port is generated, a location to be printed by the failure ejection port originally is required to be printed by the other normal ejection port. Accordingly, to cope with such a situation, the present embodiment uses not only the array B and the array C, but also the array A capable of printing the same raster as that of the array C and further the array D capable of printing the same raster as that of the array B. However, when the uneven thickness accompanied with the impact displacement mentioned above is desired to be suppressed in more priority than the case in which image degradation caused by the failure ejection port is suppressed, a situation using only the array C and the array B is effective. In addition, to consider that the failure ejection port is not so often generated, a mode in which two arrays of the array C and the array B are used also belongs to a category of the present invention.

Further, to consider realizing printing with fewer portions in which the impact location is displaced, the data assigning ratio may be different from the one mentioned above. For example, when a ratio combination of the array A:the array B:the array C:the array D=1:X:X:1 is set, X can be thought to take 2, 4, 5, or more larger value, therefore, a mode of $X \geqq 2$ belongs to a category of the present invention. However, the greater a value of X, the less multi-pass effect, and in addition, the larger a life difference between the ejection port arrays. In the present embodiment, a ratio combination of the array A:the array B:the array C:the array D=1:3:3:1 is set as the optimum data assigning ratio in consideration of these situations.

In addition, when the distribution ratio of the image data indicating the half tone is defined as the array A:the array B:the array C:the array D=Y:1:1:Y, the ratio belongs to a category of the present invention when the ratio is $0 \leqq Y < 1$. In particular, in the case of Y=0, only two arrays of the array B and the array C are set to be employed.

Further, the data distribution ratios of the array A and the array D may not be the same, and also the data distribution ratios of the array B and the array C may not be the same. However, a sum of the data distribution ratios of the array A and the array C which print the same raster is required to be 50%, and similarly, a sum of the data distribution ratios of the array B and the array D is required to be 50%.

Within an area shown in FIG. 9, the pixel positions printed by the ejection ports of array A are 8 portions, the pixel positions printed by the ejection ports of array B are 24 portions, the pixel positions printed by the ejection ports of array C are 24 portions, and the pixel positions printed by the ejection ports of array D are 8 portions. This shows that a ratio combination is set to be the array A:the array B:the array C:the array D=1:3:3:1 as with the above-mentioned data assigning ratio. Here, although an example of relatively monotonous pattern is shown to facilitate understanding of this description, the data assigning ratio of each array has only to be the above-mentioned ratio as a whole, and a mask pattern is not limited to the pattern of FIG. 9.

Figure 10:
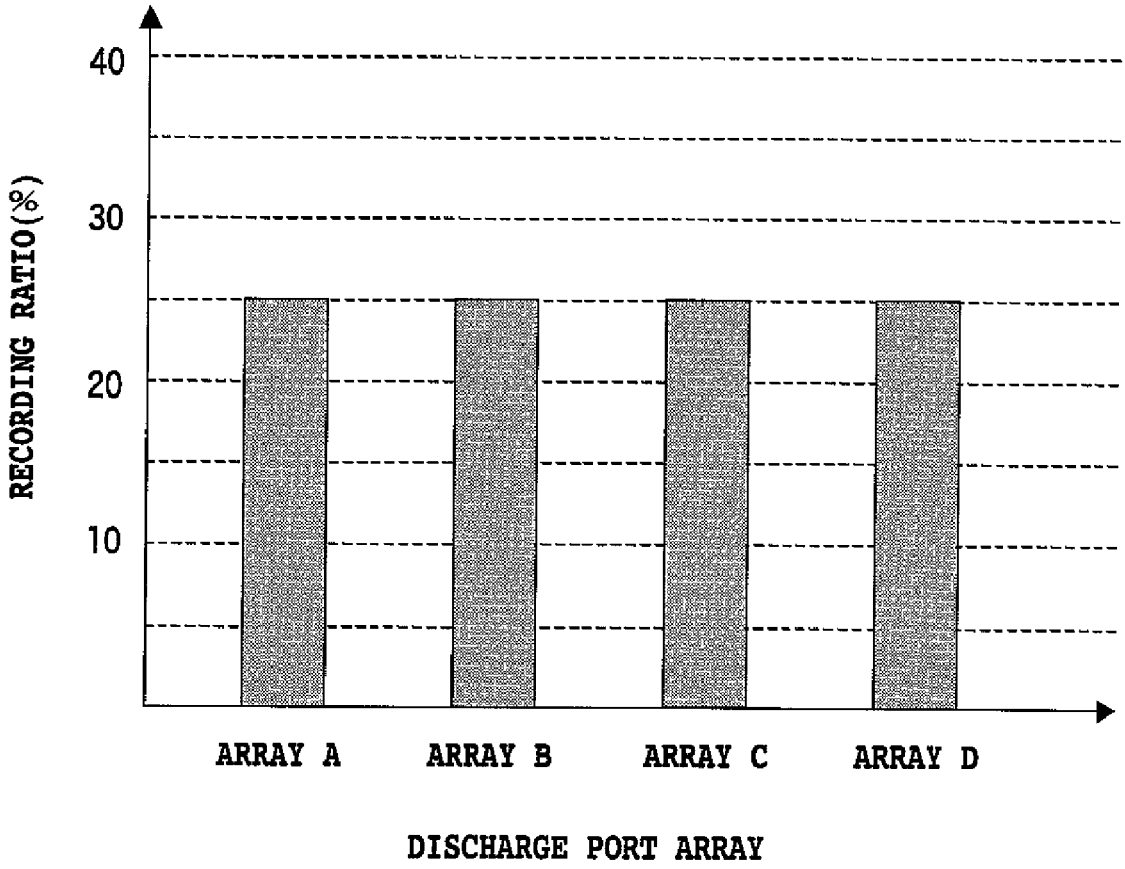
FIG. 10 is a diagram showing a data assigning ratio with respect to each ejection port when portions except a half tone portion, namely, a bright portion and a dark portion are printed.

On the other hand, FIG. 10 is a diagram showing the data assigning ratio (printing ratio) with respect to each ejection port array when portions except the half tone portion, namely, the bright portion and the dark portion are printed. Here, the printing ratio in a non-joint portion mentioned above is shown. Four arrays of the array A, the array B, the array C, and the array D are set to be 1:1:1:1 in ratio, and the printing of 100% is performed in all four arrays. Specifically, when the image data after the binary process is assigned to each array, the data distribution is performed so that the ratio may become the above-mentioned ratio.

Figure 11:
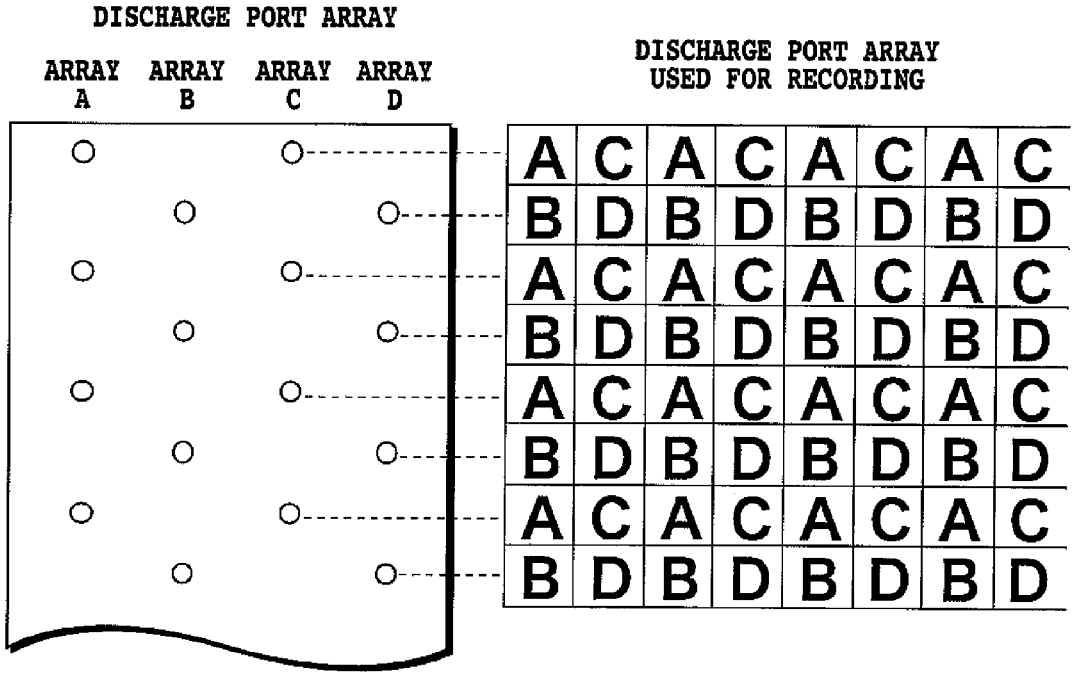
FIG. 11 is a diagram showing a mask for realizing a data distribution of FIG. 10.

FIG. 11 is a diagram showing a specific example of the mask by associating with the ejection port array of the head for realizing the data distribution of FIG. 10. A right side in the figure shows in the pixel locations that the data is to be distributed to the ejection port of which array among A, B, C, and D. At this time, the pixel locations printed by each ejection ports of the array A, the array B, the array C, and the array D are 16 in total for each array, and the ratio is set to be 1:1:1:1 as with the above-mentioned printing ratio. Although, here, a relatively monotonous pattern is shown to facilitate understanding of this description, the printing ratio of each array has only to be equivalent as a whole, and a mask pattern is not limited to the pattern of FIG. 11.

Further, although, in FIG. 10 and FIG. 11, the distribution ratio of the image data showing portions except the half tone portion, namely, the bright portion or the dark portion is set to be the array A:the array B:the array C:the array D=1:1:1:1, the distribution ratio is not limited to this ratio. The distribution ratio of the bright portion or the dark portion has only to be a ratio different from the distribution ratio of the half tone mentioned above, and the distribution ratio difference has only to be smaller than that of the distribution ratio of the half tone. Namely, the distribution ratio of the half tone generates the ejection port array with high frequency in use by setting the distribution ratio difference great, and this decreases the number of the dots with the impact displacement, as a result, generation of the uneven thickness is suppressed. On the other hand, since, in the bright portion or the dark portion, the uneven thickness does not stand out compared with the half tone, the ejection port array with high frequency in use is not required to be provided. Rather than that, it is important to uniform the frequency in use of each ejection port array as much as possible. Accordingly, it is preferable that the difference of the distribution ratios of half tone be set small so that a difference of frequency in use between the ejection port arrays may not become so large. Because of the above reason, the difference of the distribution ratios of the bright portion or the dark portion is set smaller than that of the distribution ratios of the half tone.

Example

Hereinafter, a specific example is shown. When the printing is performed, using the printing apparatus of the same constitution as that of the above-mentioned FIG. 1, the example is equipped with the printing head H1 of FIG. 4 as the printing heads of 1, 2, 3, and 4. The printing heads 1, 2, 3, and 4 eject inks of black, cyan, magenta, and yellow, respectively.

Each of the printing heads 1, 2, 3, and 4 was driven so that a single ejection amount from one ejection port may be 2.8 pl. As the ink containing color material, an ink BCI-7 used for a commercially available ink jet printer PIXUS iP7100 manufactured by (Canon, Inc) is employed. As the printing medium 5 to be printed, a photo glossy paper (Pro Photo Paper, PR-101; manufactured by CANON Inc.) exclusively used for ink jet printing is prepared.

In further detail, ejecting drive frequency of the ink droplet is set to be 8 kHz, and the printing resolutions are set to be 2400 dpi in the main-scanning direction (conveying direction), and 2400 dpi in the sub-scanning direction (ejection port array direction). Furthermore, as a data of test image, a patch image data including a portion with printing duty of 100% (the bright portion), a portion with 75% (the bright portion), a portion with 50% (the half-tone portion), and a portion with 25% (the dark portion) was prepared. Further, a photographic image including various duties in addition to the above four kinds of duties was prepared. Then, the printing was performed using the same printing ratio as with the above-mentioned embodiment in such a way that the ink impacting amount is set to be 50% duty for the half-tone portion.

Figure 12:
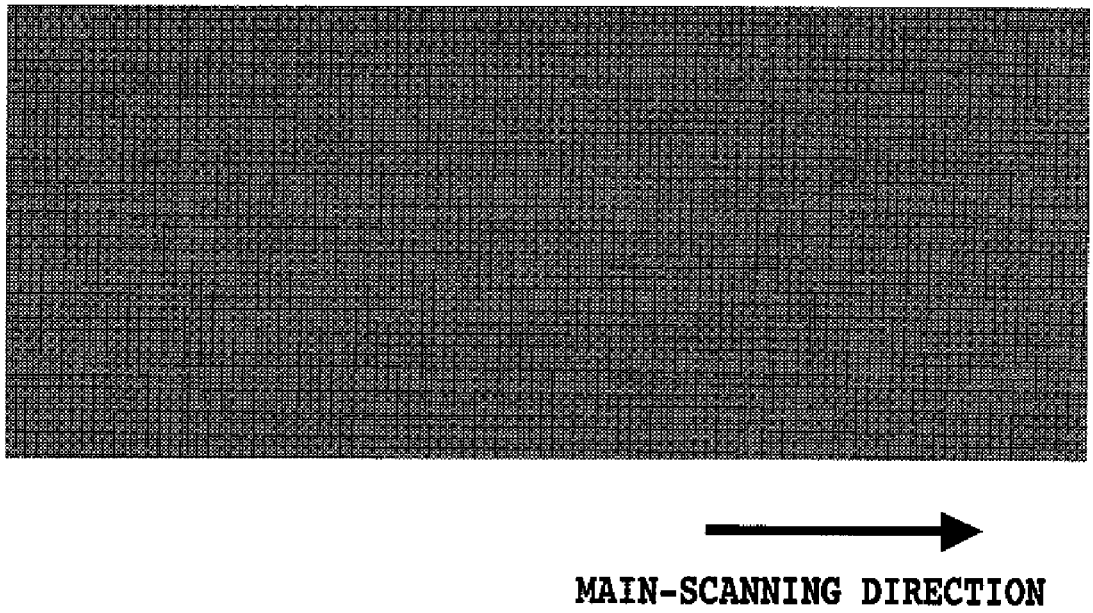
FIG. 12 shows a situation in which uneven thickness is not generated in the half tone portion.

In a setting condition above, the prepared patch image data was printed with one-time relative movements (main-scanning) of the printing head and the printing medium. At that time, a binary process of the patch image data and a data distribution process were executed according to a flowchart of FIG. 6. Specifically, the image data belonging to the bright portion (100%, 75% duty portions) and the dark portion (25% duty) among the patch image data was distributed at a ratio of 1:1:1:1 with respect to the array A, the array B, the array C, and the array D. On the other hand, the image data of the half tone portion (50% duty) was distributed at a ratio of 1:3:3:1 with respect to the array A, the array B, the array C, and the array D. The patch data above was printed by ejecting the ink from the array A, the array B, the array C, and the array D according to the image data thus distributed. As a result, the uneven thickness with respect to the main-scanning direction was hardly recognized visually in any gradation among the bright portion, the half tone portion, and the dark portion, and a picture with a sufficient image quality in which image quality degradation was not detected could be printed. FIG. 12 shows a situation of the half tone portion in patch images obtained by this printing as a schematic diagram. As can be understood from FIG. 12, according to the above printing method, a generation of the uneven thickness can be suppressed in the half tone portion.

Next, a photographic image data including various duties other than the above-mentioned four kinds of duties was printed. At that time also, the binary process of the image data and the data distribution process were executed according to the flowchart of FIG. 6. At this case also, as with the case in which the above-mentioned patch image was printed, the uneven thickness with respect to the main-scanning direction was hardly recognized visually, and the picture with a sufficient image quality in which image quality degradation was not detected could be printed.

Comparative Example

Figure 13:
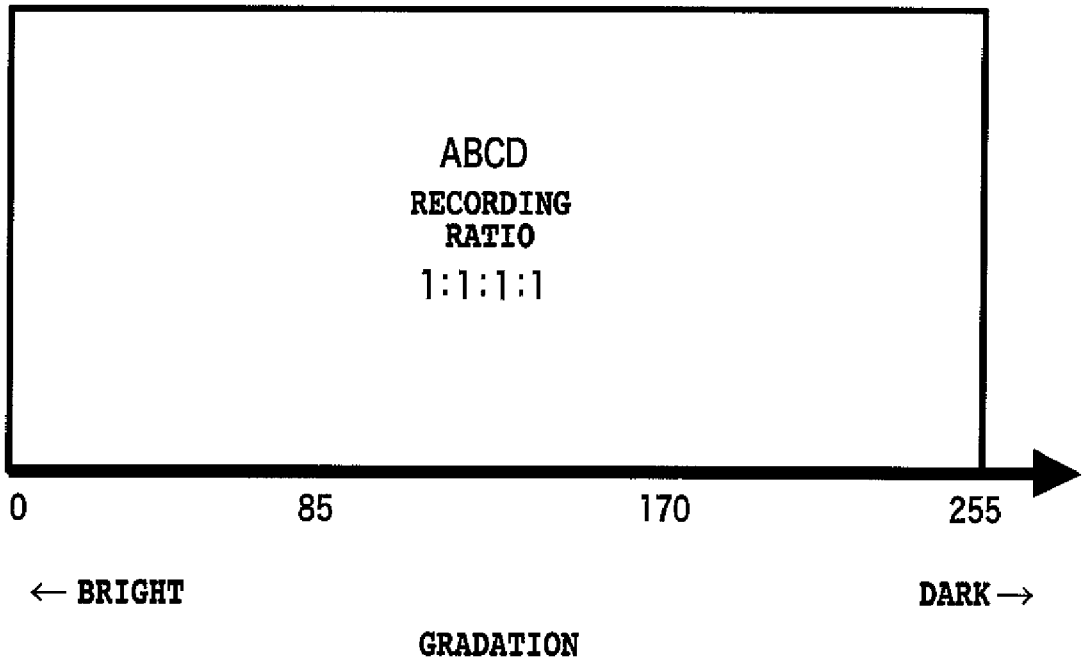
FIG. 13 is a diagram showing that printing is performed such that a distribution ratio with respect to each ejection port array is set to be 1:1:1:1 in all gradations.

FIG. 13 is a diagram for describing a comparative example for comparing with the embodiment of the present invention. In this comparative example, the printing is performed by distributing the data at a ratio of 1:1:1:1 with respect to the arrays A, B, C, and D in all gradations. In this manner, the printing ratio of four arrays A, B, C, and D is set to be 1:1:1:1.

Hereinafter, a specific comparative example is shown. Various conditions relating to the printing of the picture are the same as those of the above-mentioned examples except the data distribution ratio. As the data of the test image, the patch image data including portions with the printing duties of 100%, 75%, 50%, and 25%, with the applied ink volume of 2.8 pl, and the photographic image data in which various duties are mixed were prepared.

Figure 14:
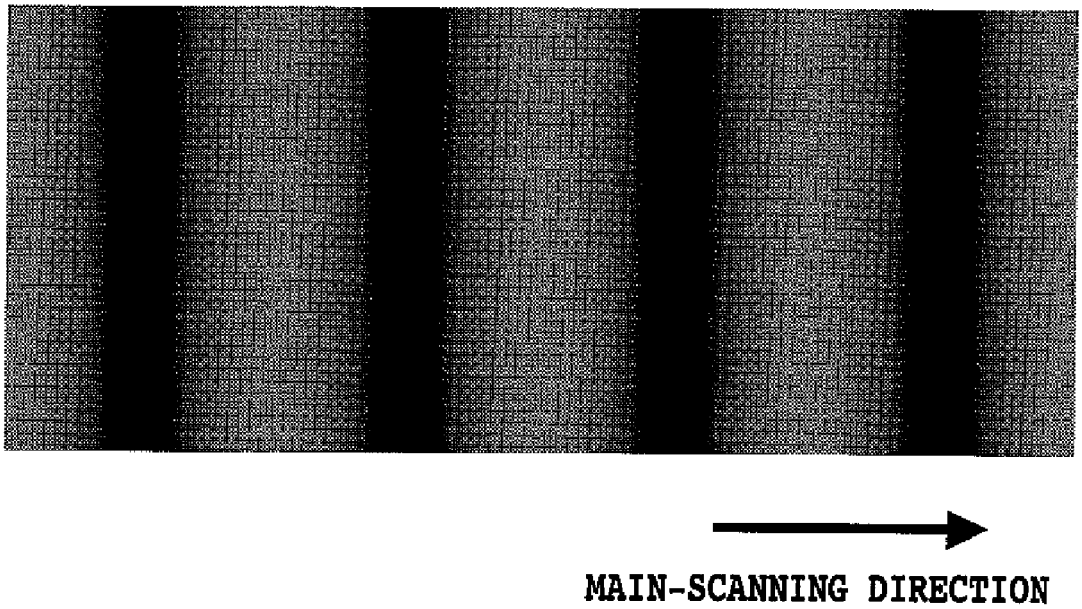
FIG. 14 shows a situation in which the uneven thickness is generated in the half tone portion.

Under the setting condition above, the prepared patch image data was printed at one-time main scanning. As a result, in a 50% duty portion corresponding to the half tone portion in particular, the uneven thickness with respect to the main scanning direction stood out, and the image quality degradation was recognized visually as a result. FIG. 14 is a diagram showing a situation in which the uneven thickness was generated in this half tone portion.

In the same way, when printing the photographic picture, the uneven thickness with respect to the main scanning direction was detected visually in particular in a gradation equivalent to the half tone portion, therefore, the result became a picture with the image quality decay.

Incidentally, when the half tone portion was printed using only two arrays of B and C, the uneven thickness is eliminated. Accordingly, for the image data of the half tone portion, a mode in which the image data is distributed to only two arrays among four arrays may be used. However, in a mode using only two arrays, since an image quality improvement effect due to multi-array is low, it is preferable that the mode be applied only in the case where the multi-array effect has no problem at least.

In this manner, the generation of the uneven thickness could be suppressed while acquiring the image quality improvement effect due to the multi-array by the printing of the half tone portion with the different distribution ratios (printing ratio) of the printing of each ejection port array in the printing head depending on the gradations.

Second Embodiment

Hereinafter, a second embodiment of the present invention will be described by referring to the figures.

In the first embodiment, although the gradation information was obtained from multi-value data, in the present embodiment, the gradation information is acquired from the binary data obtained by performing the binary process on the multi-value data. The other constitution is similar to the first embodiment.

Figure 15:
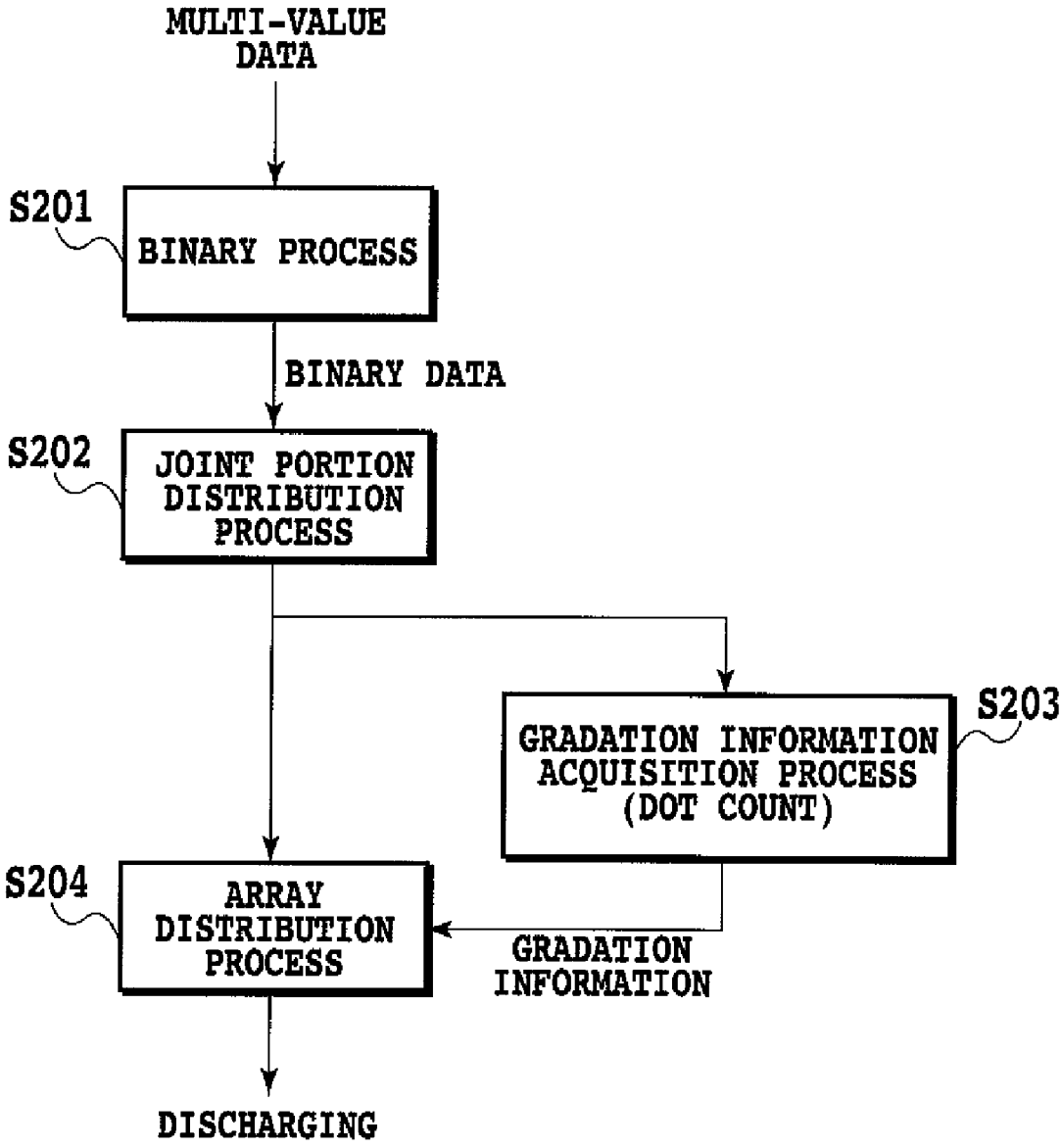
FIG. 15 is a flowchart showing image data processing in a second embodiment.
Figure 16:
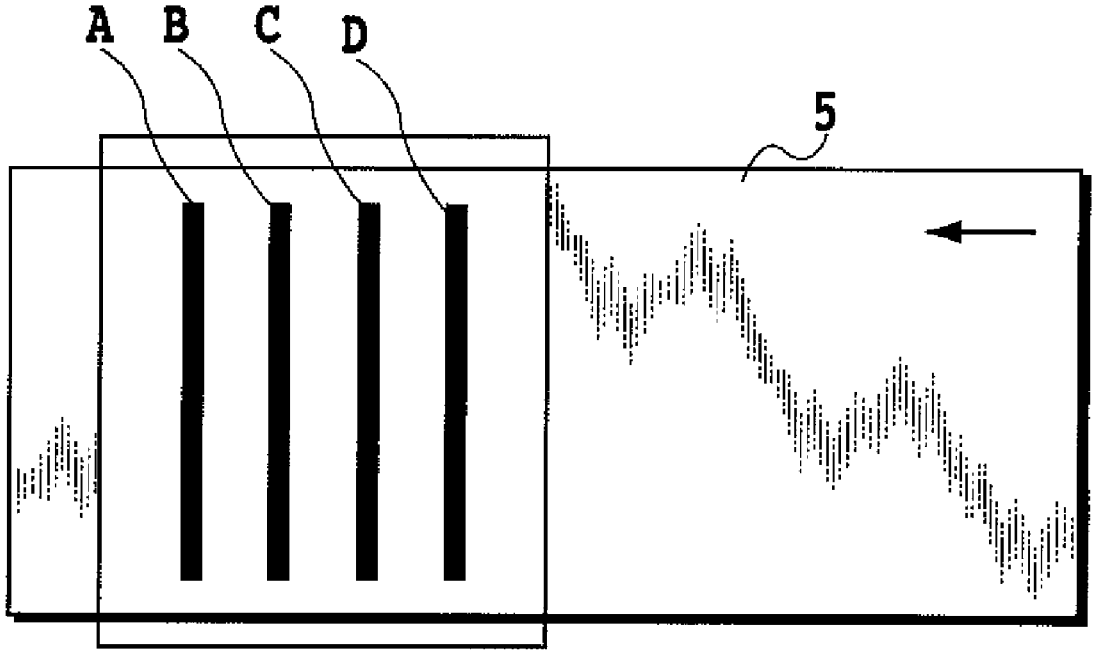
FIG. 16 is a diagram showing a situation performing the recoding in a printing medium with a printing head of 4-array constitution using the same ink color.

FIG. 15 is a flowchart showing an image data process in the present embodiment. In step S201, the binary process is performed on the multi-value data input to the image data processing portion 36. In step S202, the binary data corresponding to the joint portion is distributed into a plurality of ejection port arrays constituting the joint portion. Here, the binary data is evenly (12.5%) distributed with respect to the total eight arrays consisting of the arrays A, B, C, and D of one of adjacent chips and the arrays A, B, C, and D of the other chip. Incidentally, the distribution ratio of the data is not limited to a uniform one, as shown in FIG. 8, the distribution ratio with respect to arrays of both ends may be set relatively low, and the distribution ratio with respect to a central array may be set relatively high. After that, the data distribution process of the non-joint portion is performed in step S204, and the same binary data as that to be received by step S204 is received in step S203 also, and the gradation data is obtained here. When step S203 is described in detail, first of all, the binary data of the non-joint portion (showing ejection/non-ejection) is acquired. Next, the number of the data indicating the ejection (the number of dots) among the acquired binary data is counted for each unit region. Preferably, [unit region] shall be constituted by a plurality of pixels, in the present example, the unit region is set to be a region consisting of 16 pixels×16 pixels. Accordingly, a dot count value shows any value among 0-256. Next, the gradation information is acquired based on this dot count value. The gradation information shows that the portion belongs to which portion among the bright portion, the half tone portion, and the dark portion, and the information shows the bright portion when the dot count value is 0-85, the half tone portion in the case of 86-170, and the dark portion in the case of 171-256. In this manner, in step S203, the gradation information showing the bright portion, the half tone portion, or the dark portion is acquired for each unit region. Finally, in step S204, the binary data of the non-joint portion is distributed with respect to each ejection port array based on the gradation information obtained in step S203. The distribution ratio in this distribution process is equivalent to that of the first embodiment, the distribution ratio of the binary data corresponding to the unit region of the bright portion or the dark portion becomes a ratio combination of the array A:the array B:the array C:the array D=1:1:1:1. On the other hand, the distribution ratio of the binary data corresponding to the unit region of the half tone portion becomes a ratio combination of the array A:the array B:the array C:the array D=1:3:3:1.

An object of the present invention can be attained also by a flow of the process of the present embodiment.

Third Embodiment

The present embodiment is different in the data distribution ratio to each ejection port array, and the other feature except the data assigning ratio of the half tone portion is similar to that of the first embodiment.

In the present embodiment, the data distribution ratios of the four arrays of the array A, the array B, the array C, and the array D are set to be 3:3:1:1, and the printing of the half tone portion was performed according to these distribution ratios. Further, in another example, the data distribution ratios of the four arrays of the array A, the array B, the array C, and the array D are set to be 1:1:3:3, and the printing of the half tone portion was performed according to these distribution ratios. As a result, even in the case of any data assigning ratio, the printing result without the uneven thickness could be obtained.

In this manner, by increasing the data distribution ratios relating to the combination of the array A and the array B having small distance therebetween or the combination of the array C and the array D having small distance therebetween, it is possible to reduce the number of dots causing impact displacements and to thereby reduce the uneven thickness.

In determining these distribution ratios, since the ejecting port arrays are arranged in order of the array A, the array B, the array C, and the array D as shown in FIG. 4, a sum of the array A and the array C, and a sum of the array B and the array D are required to be 50% duty, respectively.

Other Embodiment

Even any embodiment except the first, the second, and the third embodiments does not care unless the embodiment deviates from the scope of the present invention.

For example, the number of the ejection port arrays for ejecting the same color ink is not limited to be four per one chip, the number may be two, three, five or more. Namely, a mode in which a plurality of ejection port arrays is provided for the same color belongs to the category of the present invention.

In the case of three-array constitution, the ejection port of each array is arranged not to be displaced in the ejection port arrangement direction so that all three arrays can print the same raster. Then, regarding the image data showing a specific gradation information (half tone), it is preferable that the distribution ratios with respect to both end arrays be set low (for example, 25%), and the distribution ratio with respect to the central array be set high (for example, 50%). On the other hand, regarding the image data showing the gradation information except the specific gradation information (bright portion, dark portion), it is preferable that the distribution ratio be set to be the same distribution ratio (33%) with respect to the both end arrays and the central array.

In the case of a two-array constitution, the ejection port of each array is arranged not to be displaced in the ejection port arrangement direction so that both arrays can print the same raster. Then, regarding the image data showing the specific gradation information (half-tone), it is preferable that the distribution ratio with respect to one of the arrays be set low (for example, 25%), and the distribution ratio with respect to the other array be set high (for example, 75%). Incidentally, a mode may be used in which the distribution ratio with respect to one of the arrays is set to be 100%, and only the ejection port of the one array. On the other hand, regarding the image data showing the gradation information other than the specific gradation information (bright portion, dark portion), it is preferable that the same distribution ratio (50%) be set with respect to both the one array and the other array.

In the present invention mentioned above, notwithstanding the number of the ejection port arrays, different distribution ratios are set between the specific gradation information (half tone) and the gradation information except the specific gradation information (bright portion, dark portion).

In addition, in the embodiment above, although the ejection ports of adjacent ejection port arrays are arranged to be displaced in the ejection port arrangement direction, in the present invention, arranging the above mentioned ejection port to be displaced is not indispensable. A location of the ejection port in the ejection port arrangement direction may be set equal for each array. For example, among the arrays A, B, C, and D in FIG. 5, when locations of ejection ports of the array A and the array C are left without change, and locations of ejection ports of the array B and the array D are displaced by $1/2400$ dpi in the ejection port arrangement direction, the location of the ejection port of each array is set to be the same. In this case, the printing resolution in the ejection port arrangement direction becomes 1200 dpi, and although the printing resolution is lowered in comparison with that when using FIG. 5 (2400 dpi), the printing resolution is practical enough because the printing density is hardly decreased.

Furthermore, regarding the printing head, not only an ink jet printing head equipped with the printing element capable of ejecting the ink through the ejection port but also a printing head equipped with various printing elements can be employed. Furthermore, a constitution of the ejection port arrays to which the present invention can be applied, and a printing method are not limited to only the above-mentioned embodiments.

Furthermore, the present invention can be applied to a system constituted from a plurality of apparatuses (for example, a host computer, an interface apparatus, a reader, a printer, etc.), or to an apparatus consisting of one apparatus (for example, a copy machine, a facsimile machine). Furthermore, the image data processing shown in FIG. 6 or FIG. 15 is not limited to the case where the process is executed within the printing apparatus as mentioned above, the process may be executed in an external apparatus (computer) for controlling the printing apparatus. In this case, the external apparatus executes up to a determination process (step S104 of FIG. 6, step S204 of FIG. 15) of the binary data of each ejection port array, and transfers these binary data to the printing apparatus, and then, the printing apparatus performs the printing based on the transferred data. Accordingly, when the above mentioned characteristic image data processing is performed by the printing apparatus, the printing apparatus constitutes an image processing apparatus of the present invention, and when the above mentioned characteristic image data processing is performed by the external apparatus, the external apparatus constitutes an image processing apparatus of the present invention.

Furthermore, an apparatus in which a software program code realizing a function of the above-mentioned embodiment is supplied to the external apparatus (for example, computer) connected with the printing apparatus, and the external apparatus controls the printing apparatus according to the program, is also included in a category of the present invention.

Also in this case, the software program code itself realizes the function of the above-mentioned embodiment, and the program code itself and means (for example, printing medium storing such program code) supplying the program code to the external apparatus (computer) constitutes the present invention.

As the printing medium storing such program codes, for example, a floppy disk (trademark), a hard disk, an optical disc, a magnetic optical disc, a CD-ROM, a magnetic tape, a nonvolatile memory card, a ROM, and the like can be employed.

Furthermore, the present invention is not limited to the case in which the functions of the above-mentioned embodiments are realized by the computer executing the program codes supplied. Namely, when the program codes realize the functions of the above-mentioned embodiments in cooperation with an OS operated in the computer, other application software or the like, it is needless to say that such program codes are included in the category of the present invention.

Furthermore, after the program codes supplied are stored in a function expansion board of the computer, or in a memory provided in a function expansion unit connected with the computer, a CPU provided in the function expansion board or in the function expansion unit may perform a part of actual process, or all of the process. Namely, the case in which the function of the above-mentioned embodiment is realized by a process performed by the CPU is, needless to say, included in the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-333591, filed Dec. 11, 2006, which is hereby incorporated by reference herein in its entirety.

What is claimed is:

1. An ink jet printing apparatus for printing an image on a printing medium by ejecting ink from a printing head based on image data, the printing head having a plurality of ejection port arrays each having a plurality of ejection ports which are capable of ejecting the same color ink and are arranged along a first direction, the plurality of ejection port arrays being arranged in a second direction intersecting with the first direction, comprising:

an acquiring unit that acquires gradation information of the image data; and a setting unit that sets distribution ratios of the image data with respect to the plurality of ejection port arrays according to the gradation information acquired by said acquiring unit.

2. The ink jet printing apparatus according to claim 1, wherein said setting unit, when the gradation information acquired by said acquiring unit is specific gradation information, sets relatively high distribution ratios with respect to at least two ejection port arrays adjacent to each other in the second direction among the plurality of ejection port arrays, and sets relatively low distribution ratios with respect to other ejection port arrays.

3. The ink jet printing apparatus according to claim 2, wherein said setting unit, when the gradation information acquired by said acquiring unit is other than the specific gradation information, sets equal distribution ratios with respect to the plurality of ejection port arrays.

4. The ink jet printing apparatus according to claim 1, wherein said setting unit sets different distribution ratios between a case where the gradation information acquired by said acquiring unit is specific gradation information, and a case where the gradation information acquired by said acquiring unit is other than the specific gradation information.

5. An ink jet printing method for printing an image on a printing medium by ejecting ink from a printing head based on image data, the printing head having a plurality of ejection port arrays each having a plurality of ejection ports which are capable of ejecting the same color ink and are arranged along a first direction, the plurality of ejection port arrays being arranged in a second direction intersecting with the first direction, said method comprising the steps of:

acquiring gradation information of the image data; and setting, according to the gradation information acquired in said acquiring step, distribution ratios of the image data with respect to the plurality of ejection port arrays.

* * * * *